United States Patent [19]

Yorinks et al.

[11] 4,401,955

[45] Aug. 30, 1983

[54] BROADBAND, HIGH POWER, COAXIAL TRANSMISSION LINE COUPLING STRUCTURE

[75] Inventors: Leonard H. Yorinks, Cherry Hill, N.J.; Curtis E. Milton, Jr., Cockeysville, Md.

[73] Assignee: RCA Corporation, New York, N.Y.

[21] Appl. No.: 283,604

[22] Filed: Jul. 15, 1981

[51] Int. Cl.[3] ..... H01P 5/12

[52] U.S. Cl. ..... 333/127; 333/136

[58] Field of Search ..... 333/123, 127, 128, 136

[56] References Cited

U.S. PATENT DOCUMENTS

| | | | |
|---|---|---|---|
| 3,091,743 | 1/1960 | Wilkinson . | |
| 3,904,990 | 9/1975 | LaRosa . | |
| 4,163,955 | 8/1979 | Iden et al. . | |
| 4,245,210 | 1/1981 | Landry et al. . | |
| 4,310,814 | 1/1982 | Bowman | 333/128 X |
| 4,365,215 | 12/1982 | Landry | 333/127 |

OTHER PUBLICATIONS

Ernest J. Wilkinson, "An N-Way Hybrid Power Divider," *IRE Transactions on Microwave Theory and Techniques*, 1/60, pp. 116-118.

L. I. Parad et al., "Split-Tee Power Divider," *IEEE Transactions on Microwave Theory and Techniques*, 1/65, pp. 91-95.

U. H. Gysel, "A New N-Way Power Divider/Combiner Suitable for High Power Applications," *Proc. of the 1975 IEEE Microwave Theories and Techniques Seminar*, pp. 116-118.

N. R. Landry, "High Power Coaxial Power Divider," U.S. patent application Ser. No. 226,711, filed 1/21/81.

*Primary Examiner*—Paul L. Gensler

*Attorney, Agent, or Firm*—Joseph S. Tripoli; Robert Ochis

[57] ABSTRACT

A low VSWR, high isolation microwave matched coaxial transmission line power divider/combiner compensates for parasitic reactances with lumped compensating elements to yield a compact, densely packable structure.

6 Claims, 9 Drawing Figures

BROADBAND, HIGH POWER, COAXIAL TRANSMISSION LINE COUPLING STRUCTURE

Figure 1:
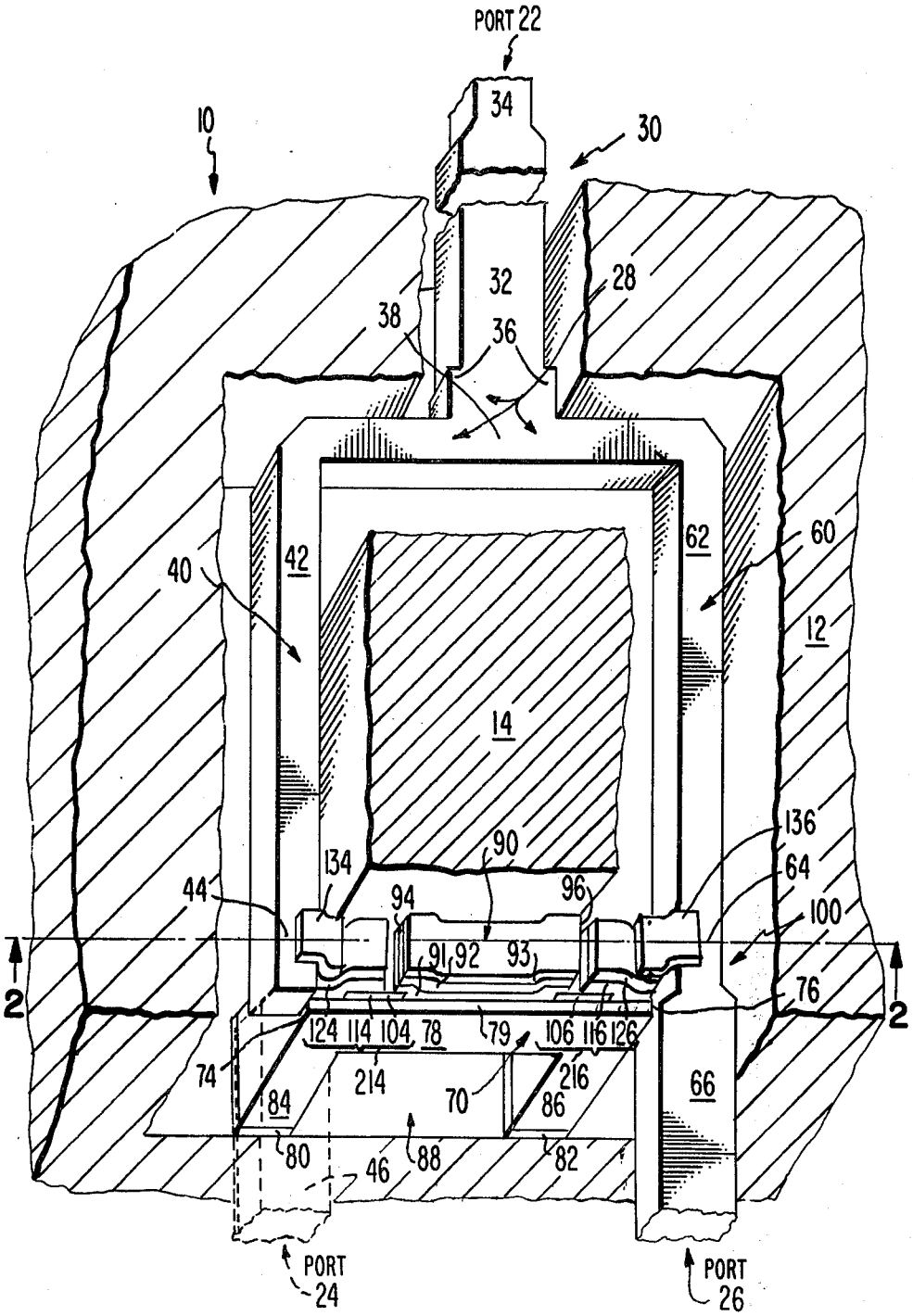

This invention is applicable to the field of high-frequency couplers and, more particularly, to the field of coaxial transmission line couplers.

An ideal, matched, microwave power divider has a common port and a plurality of branch ports or lines, divides input power applied to the common port among the branch ports in a predetermined ratio and provides isolation between the branch ports in order that reflections and other disturbances in one of the branch lines will not affect other branch lines.

A coaxial transmission line power divider providing isolation between the branch ports is described in a paper by Ernest J. Wilkinson entitled, "An N-Way Hybrid Power Divider," which appeared in the January 1960 issue of the *IRE Transactions on Microwave Theory and Techniques* at pages 116–118 and is the subject of his U.S. Pat. No. 3,091,743. In this divider the common port inner conductor is expanded into a hollow shell as a transformer section. The hollow shell is slit lengthwise into as many equal width splines as the number (N) of branch ports desired and provides equal division of power. A shorting plate at the beginning of the splines assures that all of the splines emanate from the same common junction. The slits and, thus, the splines are $\frac{1}{4}$ wavelength long at the designed operating frequency. Each spline of the cylindrical shell, which is a $\frac{1}{4}$ wavelength transformer section, may be considered the initial portion of its associated branch inner conductor and has a different isolation resistor associated with it. All of the resistors have the same value. Each resistor has a first end connected to the first ends of all the other resistors at a common floating node of the resistors and a second end connected to its associated spline $\frac{1}{4}$ wavelength from the common junction of the splines. The end of each spline remote from the common junction of the splines is connected to the inner conductor of a connector to which the continuing portion of that branch line can be connected as well as to the second end of its associated resistor. In the special but important case of two branch ports, the art has merged the two isolation resistors to form a single resistor.

A non-equal power division version of the Wilkinson divider is described in an article entitled, "Split-Tee Power Divider" by Parad et al. at pages 91–95 of the *IEEE Transactions on Microwave Theory and Techniques* for January 1965. A strip line implementation of their design is illustrated in the article. In it the "splines" are of unequal width and the isolation resistors are of unequal values in order to provide matched uneven power division.

Both of the above structures suffer from the problem of having limited power handling capabilities due to structural limitations on the conduction of heat away from the isolation resistors.

Techniques overcoming these power limitations are disclosed in U.S. Pat. No. 3,904,990 to La Rosa, U.S. Pat. no. 4,163,955 to Iden et al. and in an article entitled, "A New N-Way Power Divider/Combiner Suitable for High Power Applications" by Gysel at pages 116–118 of the *Proceedings of the* 1975 *IEEE Microwave Theories and Techniques Seminar.* Each of these techniques uses transmission lines to physically space the isolation resistors from the junctures of the inner conductor splines with their associated branch inner conductors. High power, grounded, heat sunk, external isolation resistors are matched to these transmission lines, thereby solving the heat dissipation problems of the earlier structures. Each of these structures trades a problem of bulkiness for the power handling problems of the Wilkinson and Parad et al. structures.

Each of the above references is incorporated herein by reference.

High power coaxial transmission line power dividers are needed which are similar in size to low power dividers and have the same low loss characteristics or at least have only small increases in loss. This need is particularly acute in structures such as phased array antennas where many two-branch dividers or combiners are connected in a tree structure for beam formation and where small size and low weight are important for the overall structure.

N. R. Landry, in a patent application assigned to the present assignee and entitled, "High Power Coaxial Power Divider," Ser. No. 226,711 filed Jan. 21, 1981, now U.S. Pat. No. 4,365,215, describes and claims a technique for improving the power handling capabilities of coaxial transmission line power dividers without significantly increasing their bulk. In the embodiments of that technique illustrated in the Landry application, the branch line inner conductors bend perpendicular to the axis of the spline section at the end of the spline section. The odd mode power dissipation resistor(s) is located across the end of the spline section in the space between the inner conductor and the outer conductor on an electrically insulating, thermally-conducting heat sink which is thermally connected to the outer conductor. A low inductance connection is achieved between the resistor(s) and the inner conductor legs because of their very close proximity which is made possible by the perpendicular bends. The heat sink and outer conductor configuration together place a region of low dielectric constant between the outer conductor and the resistor support portion of the heat sink in order to minimize even mode losses. This Landry application is incorporated herein by reference.

The present invention builds on the Landry technique to maintain the power handling capabilities of the Landry coaxial power divider structure and provides a configuration which may be closely packed in a planar structure.

In accordance with one preferred embodiment of the present invention, the splines and adjacent portions of the branch legs are co-linear. Compensating elements minimize the harmful effects of parasitic reactances in this structure which include significant inductance in the connection of the isolation resistor to the branch legs of the inner conductor. Compensating capacitors series resonate the inductance of the resistor connections and compensating inductive reactance parallel resonates the parasitic capacitance between the odd mode power dissipation resistor and the outer conductor.

Figure 2:
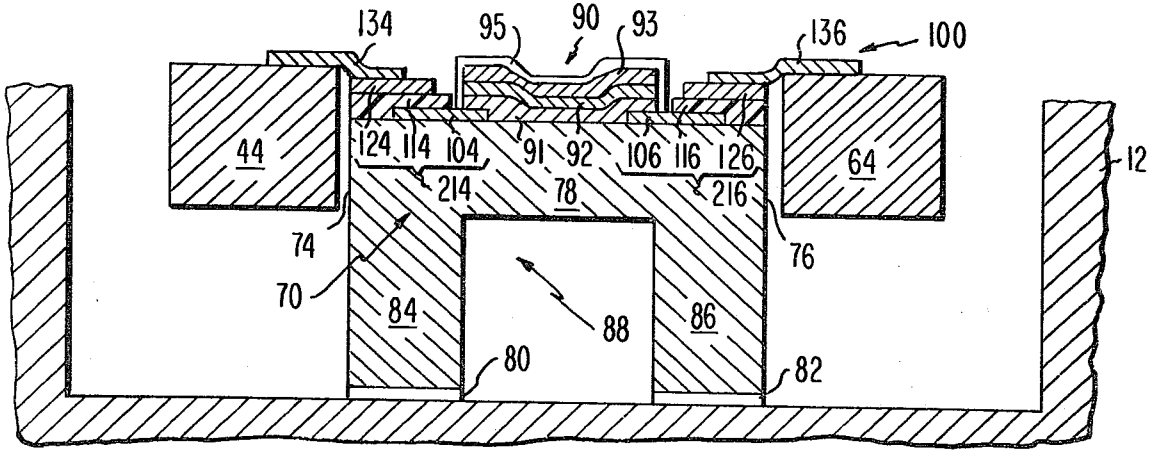
Figure 6:
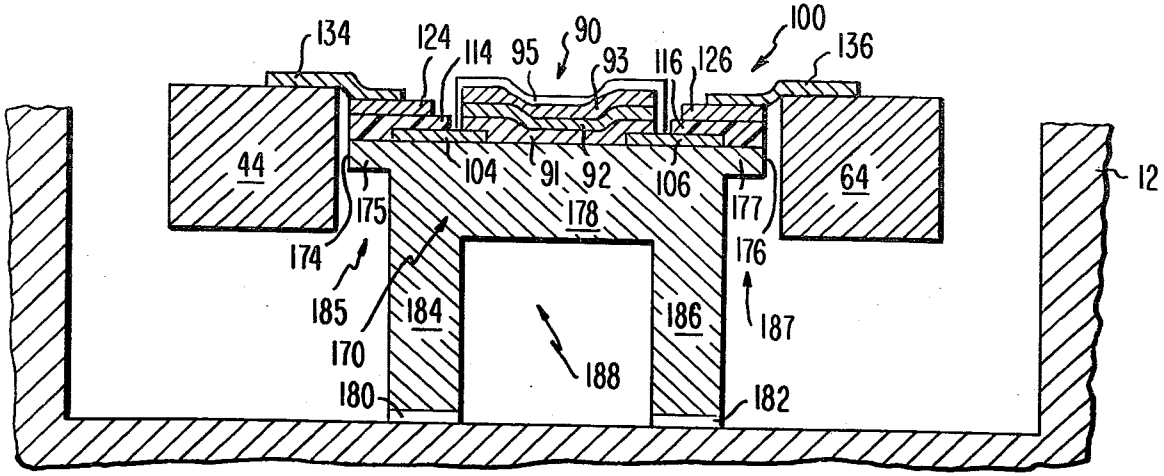
Figure 3:
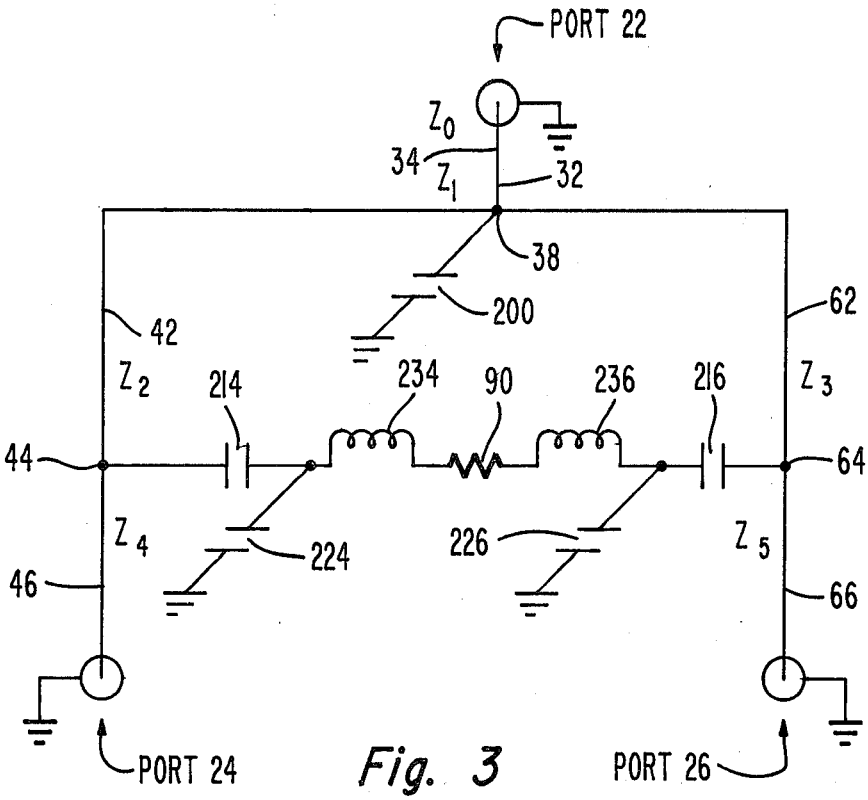
Figure 4:
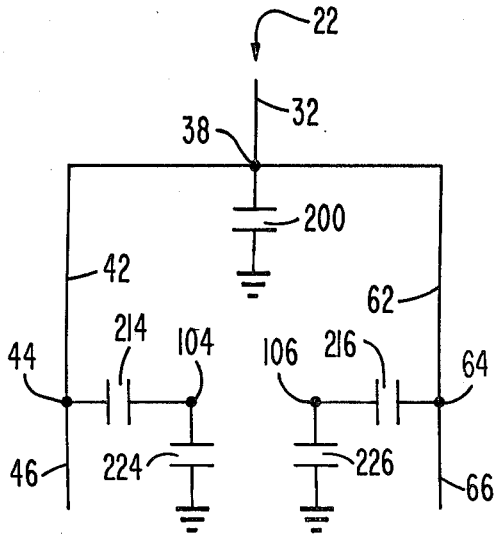
Figure 5:
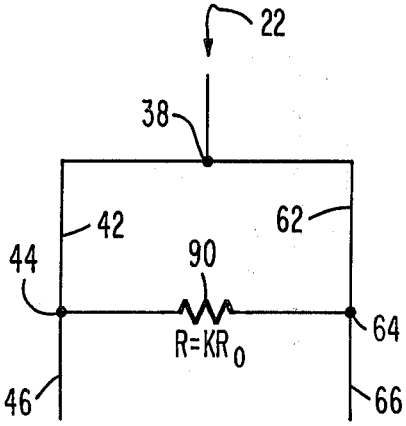
Figure 7:
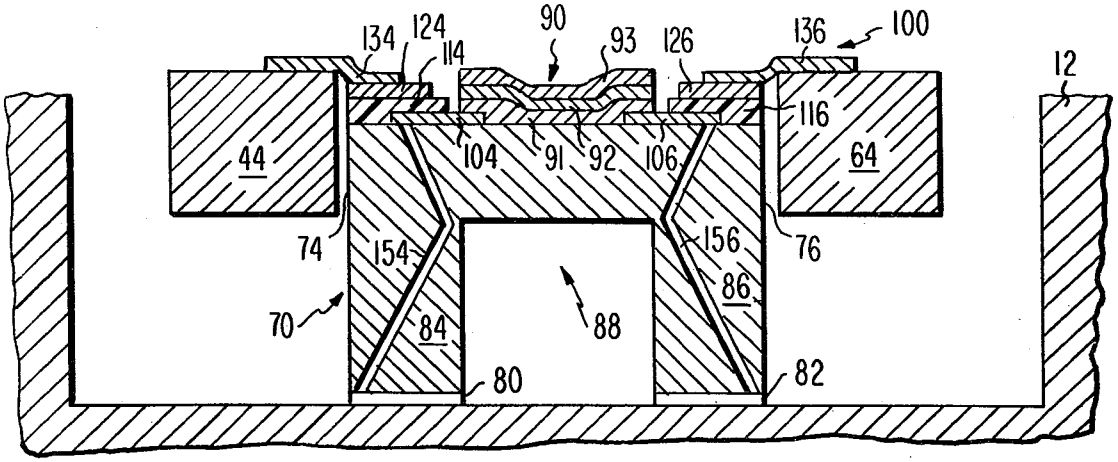
Figure 9:
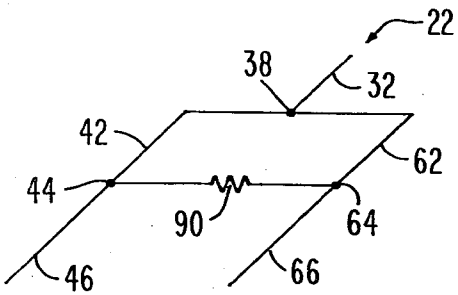
Figure 8:
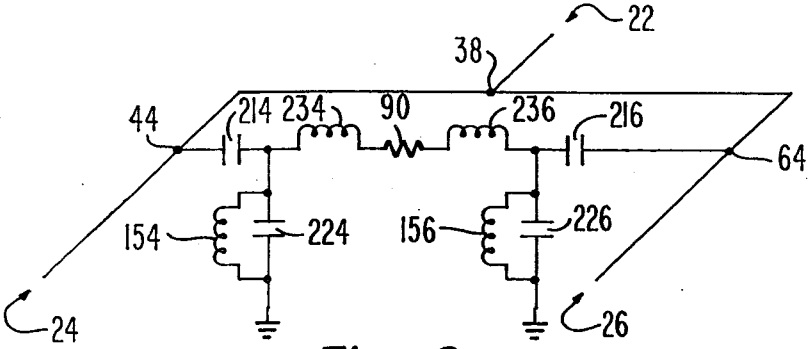

In the drawing:

FIG. 1 is a perspective view of a coaxial transmission line coupling structure in accordance with a preferred embodiment of the invention, FIG. 2 is a cross-section of the structure in FIG. 1 taken along the line 2—2, FIGS. 3–5 are equivalent circuits for the structure of FIG. 1, FIG. 6 illustrates an alternative configuration for the heat sink in FIG. 2, FIG. 7 illustrates an alternative technique for compensating for parasitic reactances, FIGS. 8 and 9 are equivalent circuits for the structure of FIG. 7.

In FIG. 1 a preferred rectangular coaxial transmission line embodiment of the inventive divider/combiner 10 is illustrated with a portion of the outer conductor 12 removed to reveal the inner conductor system 28. Coupler 10 has a common port 22 and two branch ports 24 and 26, all with characteristic impedances $Z_0$. Inner conductor system 28 has a generally tuning fork configuration in which the common leg 30 of the inner conductor corresponds to the tuning fork handle and the branch legs 40 and 60 of the inner conductor correspond to the vibrating arms of the tuning fork.

Common leg 30 has an initial portion 34 which, with its surrounding outer conductor, has a characteristic impedance $Z_0$ and a final portion 32 which, with its surrounding outer conductor, has a characteristic impedance $Z_1$. Portion 32 is substantially $\frac{1}{4}$ transmission line wavelength long.

Branch legs 40 and 60 each have an initial portion (42, 62) substantially $\frac{1}{4}$ transmission line wavelength long from the vicinity of a common junction 38, to an intermediate portion (44, 64) of legs 40 and 60. The intermediate portion (44, 64) of legs 40 and 60 is coupled to a remote portion (46, 66) still further from common junction 38 and also nominally $\frac{1}{4}$ wavelength long. The initial portions 42 and 62 of inner conductor branch legs 40 and 60 merge with the final portion 32 of common leg 30 at a common junction 38.

Inner conductor leg portion 42 has a characteristic impedance of $Z_2$ in combination with the surrounding portion of the outer conductor. Inner conductor branch leg portion 62 has a characteristic impedance $Z_3$ in combination with its surrounding outer conductor. In FIG. 1, the portion of the outer conductor which surrounds leg portions 42 and 62 has two identified portions, the main portion 12 and a pillar 14 which is located between the legs 42 and 62 along the "upright" portions of the tuning fork arms. The pillar 14 of outer conductor can be omitted between the common junction 38, the initial portions 42 and 62 of the branch legs and a dissipation element 100, if the line impedances in its absence are properly accounted for. Inner conductor branch leg portion 46 has a chracteristic impedance $Z_4$ in combination with its surrounding outer conductor and inner conductor branch leg portion 66 has a characteristic impedance $Z_5$ in combination with its surrounding outer conductor.

An odd mode power dissipation element 100 is connected between inner conductor branch leg intermediate portions 44 and 64 and is supported by a BeO heat sink 70. Heat sink 70 (FIG. 2) is generally U-shaped with the open end of the U in contact with the outer conductor 12. A resistor support portion 78 along the base of the U has an upper (in FIG. 1) surface 79 which supports dissipation element 100. A first end 74 of the heat sink is adjacent inner conductor portion 44 and a second end 76 is adjacent inner conductor portion 64. Resistor support portion 78 is spaced from outer conductor 12 by a leg or pedestal 84 at its first end and a leg or pedestal 86 at its second end. Bonding layers 80 and 82 secure pedestals 84 and 86 to outer conductor 12. Bonding layers 80 and 82 may preferably be solderable metalized layers formed on pedestals 84 and 86, respectively, in combination with solder securing them to outer conductor 12.

The odd mode power dissipation element 100 comprises two thick film capacitors (214 and 216) and a thick film resistor 90 and is disposed on the upper surface 79 of heat sink 70. Capacitor 214 has an upper electrode 124, a dielectric 114 and a lower electrode 104. Capacitor 216 has an upper electrode 126, a dielectric 116 and a lower electrode 106. The lower electrodes 104 and 106 of the capacitors are disposed on heat sink upper surface 79 and such protrudes beyond its associated dielectric 114 or 116.

Resistor 90 is preferably a multilayer thick film resistor of the type disclosed in U.S. Pat. No. 2,245,210 to Landry et al. and is illustrated as comprising three layers, 91, 92 and 93 of resistive material and has ends 94 and 96. The first layer 91 makes ohmic contact to part of the protruding portion of conductor 104 at one end of resistor 90 and part of the protruding portion of conductor 106 at the other end of resistor 90. In between conductors 104 and 106 layer 91 is disposed on heat sink upper surface 79. The second layer 92 covers layer 91 and the third layer 93 covers layer 92. A dielectric layer 95 (not shown in FIG. 1) covers layer 93 and serves to prevent the resistive material from absorbing moisture.

Thick film fabrication of capacitors 214 and 216 is preferred because very little modification of the process for producing thick film resistor 90 in accordance with U.S. Pat. No. 4,245,210 is needed to produce capacitors 214 and 216 simultaneously with resistor 90. A compact, reliable odd mode power dissipation element 100 results from use of such a thick film fabrication process.

Each of the electrodes 104, 106, 124 and 126 is preferably wide and flat to minimize inductance. Upper electrode 124 of capacitor 214 is connected to inner conductor portion 44 by a wide flat conductor 134. Alternatively, a spring loaded contact may be used to allow differential motion between the inner conductor and the resistor which is fastened to the outer conductor. This is advisable where high average power will be applied since the inner conductor will heat due to dissipation and will expand and strain the structure if relative motion is not provided for. Upper electrode 126 of capacitor 216 is similarly connected to inner conductor portion 64 by a wide flat conductor 136.

Heat sink 70 carries heat from the resistor 90 to the outer conductor 12 in an efficient manner which allows high power operation of the divider/combiner 10. At the high frequencies at which this structure is designed to operate, even the wide flat conductors of element 100 have an associated inductance. An equivalent circuit for the structure thus far described is presented in FIG. 3. The two inductors 234 and 236 correspond to the inductance of the electrodes 104, 106, 124, 126, conductors 134 and 136 and the resistor 90.

Because of the relatively high dielectric constant of the BeO material of which conductor 70 is fabricated, heat sink 70 introduces parasitic capacitance between the outer conductor and the power dissipation structure 100. In the equivalent circuit these parasitic capacitances are modeled by the capacitors 224 and 226, which may be referred to as pedestal capacitors since they are primarily a result of the relatively high dielectric constant of the pedestals. The open space 88 between the resistor support portion 78 of heat sink 70 and the outer conductor 12 reduces the magnitude of capacitors 224 and 226 by reducing the area of their dielectrics and thereby reduces energy storage. This also minimizes the even mode displacement currents which flow in resistor 90 which contribute to the even mode loss of the structure as explained in the Landry application (Ser. No. 226,711) previously referred to.

A capacitor 200 at the common junction 38 in FIG. 3 is induced by the projections 36 on the inner conductor common leg 32 in the vicinity of the common junction 38. These projections have the effect of creating a short, low impedance, transmission line section at the end of portion 32. This low impedance section acts like a capacitor (200).

The compensation capacitors 214 and 216 are provided in order to provide local compensation for the inductances 234 and 236 over the designed operating frequency band. The capacitors 214 and 216 are preferably formed as part of the same thick film processing sequence as a resistor 90. This can be accomplished with the addition of one processing step to the resistor formation process. The close proximity of the capacitors 214 and 216 to the inductors 234 and 236 minimizes energy storage elements in the system and thereby maximizes bandwidth. Further, with the use of this integral compensation structure the value of the resistor 90 for maximum branch port-to-branch port isolation varies by only 2.5 percent for dividers having unbalance ratios ranging from 0 dB to 3 dB. This enables the power dissipation elements for dividers throughout this range to be fabricated to a single target value. If closer resistor matching is desired, more closely matched resistors can be selected from the normally occurring distribution in resistor values.

If, instead of the integral, adjacent, compensating capacitors, some other compensation technique were utilized to compensate the inductances 234 and 236, such as modifying the lengths and impedances of the transmission lines, individually tailored resistors would be needed to provide the same degree of branch port-to-branch port isolation. This would complicate both the fabrication of component parts and the process of assembling a divider/combiner tree network.

The first compensating capacitor 214 and the first parasitic or pedestal capacitor 224 are connected in series between inner conductor segment 44 and outer conductor 12. These capacitors in conjunction with inductor 234 act as a step-up transformer at their common node to which the first end of resistor 90 is connected. The second compensating capacitor 216, the second pedestal capacitor 226, and the inductor 236 also act together as a step-up transformer. As a result, the value of resistor 90 must be adjusted in order for its resistance value as transformed to inner conductor portions 44 and 64 to be effective in making the divider 10 a matched divider.

When the power divider is excited in the even mode, such as when port 22 is excited, there is no voltage between inner conductor portions 44 and 64. The even mode equivalent circuit of the dissipation element 100 of FIG. 3 therefore reduces to the equivalent circuit in FIG. 4 which provides no cross connection between portions 44 and 64 since conductors 104 and 106 are at the same voltage. Therefore, the equivalent circuit of FIG. 4 has only capacitors 214 and 224 connected in series between portion 44 and ground and capacitors 216 and 226 connected in series between portion 64 and ground. For odd mode signals the equivalent circuit of FIG. 3 reduces to essentially the equivalent circuit of FIG. 5 with the resistor 90 having an effective resistance of $R=KR_0$ where $R_0$ is the resistor 90's actual resistance in the designed frequency band and K is the impedance step-up ratio of the capacitor-inductor step-up transformers.

As is well known in the art, the reflection caused by a capacitor connected at a point between the two conductors of a transmission line can be nearly cancelled by placing an equal capacitance slightly less than one-quarter wavelength along the transmission line from the first capacitor. When the reactance of each capacitor is 7 or more times the characteristic impedance of the transmission line, the net reflection coefficient remains below 0.025 over a 17% frequency band. Therefore, capacitor 200 serves to cancel the reflections due to capacitors 214, 224, 216, and 226.

An alternative approach to eliminating the effect of capacitors 224 and 226 is shown in FIGS. 7–9 and will be discussed later in this specification.

The structure of FIG. 1 was fabricated to optimize operation in the 3.1 to 3.5 GHz frequency band. A rectangular coaxial structure was used because such a structure can be fabricated using a numerically controlled milling machine which provides high accuracy and repeatability. Heat sink 70 has a length of 0.4 inch (1.02 cm), an overall height (not including bonding layers 80 and 82) of 0.2 inch (0.51 cm) and a width of 0.125 inch (0.32 cm). Each pedestal is 0.075 inch (0.19 cm) long parallel to the length of body 70. The central air space 88 is thus 0.25 inch (0.64 cm) long and has a height of 0.1 inch (0.25 cm). Resistor 90 has a value of 75 ohms to produce an effective resistance of 100 ohms after step-up transformation ($K=4/3$). The pedestal capacitors 224 and 226 have values of about 0.08 pf (picofarad) and the compensation capacitors have values of about 0.5 pf. The capacitance 200 has a value of about 0.16 pf. The connecting conductors 134 and 136 are each 0.12 inch (0.3 cm) long by 0.10 inch (0.25 cm) wide by 0.005 inch (0.01 cm) thick.

The resulting coupler has a VSWR of less than 1.15 at each of its ports and a branch port-to-branch port isolation of greater than 22 dB throughout this frequency band. If a higher VSWR is considered acceptable, then this structure has a wider effective operating frequency band than the stated 3.1 to 3.5 GHz.

FIG. 6 illustrates an alternative heat sink 170 which may be substituted for heat sink 70. Heat sink 170 is similar to heat sink 70 and the parts of structure 170 have reference numerals higher by 100 than the corresponding portions of the structure 70. In the structure 170, the sides of the pedestals 184 and 186 are set back farther from the inner conductor portions 44 and 64, respectively, than is the case with the pedestals 84 and 86 of structure 70. This creates larger air gaps 185 and 187 between the pedestals and the inner conductors and increases the path length between the inner conductor and the outer conductor along the surface of the heat sink. The resulting increased path length reduces the chance of the creation of an arc between an inner conductor and the outer conductor along a surface of the heat sink. In order to provide these increased air gaps 185 and 187 while retaining the same power dissipation element 100 structure, extensions or ledges 175 and 177 are provided adjacent the first and second ends, respectively, of structure 170 in order that the upper surface 179 of heat sink 170 may have the same length as the upper surface 79 of heat sink 70.

In FIG. 7, an alternative mechanism for eliminating the adverse effect of capacitors 224 and 226 within the designed frequency band is illustrated. In this configuration, a first inductor 154 extends along pedestal 84 from the conductor 104 to the bonding layer 80 and a second inductor 156 extends along pedestal 86 from conductor 106 to bonding layer 82. The values of inductors 154 and 156 are selected to parallel resonate capacitors 224 and 226, respectively, in or near the designed operating frequency band. The projection 36 on the inner conductor near common junction 38 is preferably omitted when this technique is used. The equivalent circuit for this structure is illustrated in the circuit diagram of FIG. 8. Over the designed frequency band each of the resonant parallel LC circuits (154, 224 and 156, 226) presents a high impedance and each of the series resonant LC circuits (214, 234 and 216, 236) present a very low impedance. Consequently, within the designed band the equivalent circuit of FIG. 7 reduces to the purely resistive equivalent circuit of FIG. 9. For even mode signals the voltage differential between inner conductor portions 44 and 64 is zero and dissipation element 100 reduces to an open circuit, for odd mode signals it is purely resistive. This structure unlike that of FIGS. 1, 3 and 4 does not transform the resistance of resistor 90.

Which technique (FIG. 1 or FIG. 7) is used to produce parallel inductors is a matter of design choice and depends on, among other things, the operating frequency, the desired bandwidth and the power handling capacity of the structure since a proper inductive value must be obtained without utilizing conductor lines 154 and 156 which are so thin as to be unreliable or which cannot be repeatedly fabricated to the required tolerances.

In the absence of the compensating capacitors 214 and 216 and the compensating inductances 154 and 156, the parasitic reactances (capacitors 224 and 226 and inductors 234 and 236) would cause impedance mismatches at each of the divider/combiner ports and would reduce the isolation between the branch ports.

With the compensating capacitances and reactances present, the overall effect of the power dissipation structure 100 within the designed frequency band is a resistor with effectively no parasitic reactances.

The power divider/combiner 10 has a low VSWR at each of its three ports and a high isolation between its branch ports. As a consequence, a power distribution or collection network comprised of a tree of these divider/combiners has a desired low VSWR and high branch port-to-branch port isolation. This makes possible the fabrication of a large very low sidelobe level array antenna (sidelobe levels down more than 55 dB from the main beam on an RMS basis).

A high isolation, low reflection coaxial transmission line coupling structure has been shown and described. Those skilled in the art will be able to make further variations in the preferred embodiment without departing from the spirit of the invention. The protection afforded the present invention is limited only by the appended claims.

What is claimed is:

1. A coaxial transmission line coupling structure for coupling a common port to first and second branch ports, said structure designed for operation over a predetermined frequency band, said structure comprising:

an inner conductor system including a common leg and first and second branch legs, said branch legs joined to said common leg and each other at a common junction;

an outer conductor spaced from, and coaxially enclosing, said inner conductor system;

a heat conductive, dielectric body disposed adjacent said inner conductor branch legs, said body making thermally conducting contact to said outer conductor;

an odd mode power dissipation element comprising a series compensating capacitor-resistor-compensating capacitor circuit connected between said branch legs with its connection to each branch leg substantially $\frac{1}{4}$ transmission line wavelength along that branch leg from said common junction at a frequency within said band;

said resistor disposed in thermally conducting contact with said heat conductive dielectric body, said odd mode power dissipation element having inductance associated with it, said compensating capacitors series resonating said inductance to present relatively low reactances in series between said first and second branch legs and said resistor at frequencies in said band;

said dielectric body contributing to parasitic capacitances between said odd mode power dissipation element and said outer conductor; and reactive compensation means for minimizing the adverse effects of said parasitic capacitances at frequencies within said band.

2. The coupling structure recited in claim 1 wherein: said reactive compensation means is a capacitive reactance in the vicinity of said common junction.

3. The coupling structure recited in claim 1 wherein a portion of said outer conductor extends between the branch legs between said common junction and said power dissipation element.

4. The coupling structure recited in claim 1 wherein said compensating capacitors and said resistor are thick film elements formed during a single sequence of thick film fabrication steps.

5. The coupling structure recited in claim 1 wherein: said reactive compensation means comprises two inductors each physically in parallel with one end of said heat conductive body.

6. In a coaxial transmission line coupling structure for coupling a common port to two branch ports and having an inner conductor system including a common leg and two branch legs which merge at a common junction and which has an isolation resistor connected between the branch inner conductor legs about $\frac{1}{4}$ transmission line wavelength from said common junction at a frequency within the designed operating band and which has an outer conductor enclosing said inner conductor system and which incorporates a dielectric heat sink disposed in good thermally conducting contact with both said resistor and said outer conductor and in which said isolation resistor has an associated inductance, the improvement comprising:

two compensating capacitors integral with and in series with said isolation resistor, said compensating capacitors having values which series resonate the inductance associated with said isolation resistor to provide a low reactance in series with said isolation resistor between said inner conductor branch legs at frequencies within said designed operating frequency band; and two compensating inductive reactances for parallel resonating the parasitic capacitances between said resistor and said outer conductor, said inductive reactances having values which parallel resonate said parasitic capacitances to provide a high impedance between said resistor and said outer conductor at frequencies within said designed operating band to thereby minimize (1) the losses in the coupling structure and (2) the VSWR at the coupling structure ports and to maximize the isolation between the branch ports for frequencies within said band.

* * * * *

UNITED STATES PATENT AND TRADEMARK OFFICE
CERTIFICATE OF CORRECTION

PATENT NO. : 4,401,955

DATED : August 30, 1983

INVENTOR(S) : Leonard Howard Yorinks, et al.

It is certified that error appears in the above-identified patent and that said Letters Patent is hereby corrected as shown below:

Column 3, line 46, "chracteristic" should read -- characteristic -- ,

Column 4, line 9, "such" should read -- each --,

Column 4, line 11, "2,245,210" should read -- 4,245,210 --, and

Column 4, line 55, "conductor" should read -- heat conductor --

Signed and Sealed this

*Thirty-first* Day of *December 1985*

[SEAL]

*Attest:*

DONALD J. QUIGG

*Attesting Officer*

*Commissioner of Patents and Trademarks*